US007571820B2

(12) United States Patent
Alexander

(10) Patent No.: US 7,571,820 B2
(45) Date of Patent: Aug. 11, 2009

(54) COLLAPSIBLE MERCHANDISING DISPLAY

(75) Inventor: Jeffrey Alexander, Oradell, NJ (US)

(73) Assignee: Applied Merchandising Concepts, Inc., New Rochelle, NY (US)

( * ) Notice: Subject to any disclaimer, the term of this patent is extended or adjusted under 35 U.S.C. 154(b) by 484 days.

(21) Appl. No.: 11/442,378

(22) Filed: May 26, 2006

(65) Prior Publication Data

US 2007/0272639 A1 Nov. 29, 2007

(51) Int. Cl.
*A47G 29/00* (2006.01)

(52) U.S. Cl. ..... 211/85; 211/73

(58) Field of Classification Search ..... 211/72, 211/73, 85, 195; 206/736, 741, 740, 744; 312/258, 262; 108/115, 99
See application file for complete search history.

(56) References Cited

U.S. PATENT DOCUMENTS

| | | | | | |
|---|---|---|---|---|---|
| 1,959,619 | A * | 5/1934 | Ebert | 211/73 |
| 2,324,232 | A * | 7/1943 | Pantalone | 211/73 |
| 2,609,090 | A * | 9/1952 | Tyrseck | 206/744 |
| 4,570,805 | A | 2/1986 | Smith | |
| RE32,668 | E | 5/1988 | Smith | |
| 5,249,669 | A * | 10/1993 | Resnick et al. | 206/740 |
| 5,678,492 | A | 10/1997 | Pinkstone et al. | |
| 5,826,732 | A | 10/1998 | Ragsdale | |
| 5,868,367 | A * | 2/1999 | Smith | 248/174 |
| 6,394,290 | B1 | 5/2002 | Walsh et al. | |
| 6,871,750 | B2 * | 3/2005 | Moss et al. | 211/149 |
| 7,261,215 | B2 * | 8/2007 | Moss et al. | 211/149 |

* cited by examiner

*Primary Examiner*—Jennifer E. Novosad
(74) *Attorney, Agent, or Firm*—Cohen Pontani Lieberman & Pavane LLP

(57) ABSTRACT

A unitary blank of injection molded plastic includes a back panel, first side panels hingedly connected to the back panel, a second side panel hingedly connected to the back panel, front panels hingedly connected to the second side panel, a cover panel hingedly connected to the front panels, and shelves hingedly connected to respective first side panels. To assemble the display, the panels are folded so that the back panel, the side panels, and the front panels surround an interior space, and the cover panel overlaps the first side panels. Latches are provided to retain the cover panel on the first side panels. Each shelf is folded to extend into the interior space, where it is supported by ledges on the second side panel and held in place by tabs which snap into slots. The shelves have tongues which extend forward of the front panels.

15 Claims, 3 Drawing Sheets

COLLAPSIBLE MERCHANDISING DISPLAY

BACKGROUND OF THE INVENTION

1. Field of the Invention

The invention relates to a collapsible merchandising display having panels and shelves which are folded from a single blank of sheet material to form a display.

2. Description of the Related Art

U.S. Pat. No. 5,826,732 is entitled "Collapsible Point-of-Purchase Display Apparatus" and discloses a display which can be folded from a single unitary blank of sheet material to form a freestanding display. The blank is made from a corrugated paperboard sheet having a back panel, a first side panel connected to a lateral edge of the back panel, front panels connected to a lateral edge of the first side panel, shelves connected to top edges of the front panels, and a second side panel connected to lateral edges of the front panels. In order to create a collapsed or preassembled product, a tab along the free edge of the back panel is bonded to the free edge of the second side panel. To fully assemble the display, the shelves are folded into the interior space formed by the preassembled panels, and tabs on the rear edge of the shelves engage slots in the back panel. While the description states that the invention contemplates the use of a plastic sheet material, no embodiments specific to plastic are disclosed.

U.S. Pat. No. 5,678,492 is entitled "Display Box with Shelving Formed from Single Panel" and discloses a display formed from a single blank of sheet material having a back panel, side panels, and front panels as described above. Here a tab along the free edge of the second side panel is bonded to the back panel, and shelves hinged to the bottom edges of the front panel have apertures which are engaged by locking tabs extending forward from the back panel. The sheet material is preferably a thermoplastic with fold lines formed in the plastic by known methods.

U.S. Pat. No. 4,570,805 entitled "Foldable Display Stand" discloses a display formed from a single sheet of cardboard, once again having panels as described above. An edge of the first side panel is glued to a tab on the back panel, and shelves hinged backward from the front panels engage slots in the back panel.

Since the shelves in the prior art displays are hinged to the front panels, they cannot extend forward from the front panels, and thus limit the amount of product which can be arranged on the shelves.

SUMMARY OF THE INVENTION

An object of the invention is to provide a fully collapsible merchandising display articulated together by folding a single sheet of material and having shelves which extend forward from the front panels for improved product capacity and visibility.

Another object is to provide a sturdy injection molded plastic display which can be snapped together to form a collapsible preassembly without the use of glue or fasteners.

The collapsible merchandising display according to the invention includes a back panel having first and second lateral edges; first side panels hingedly connected to the back panel at a first fold line along the first lateral edge; a second side panel hingedly connected to the back panel at a second fold line along the second lateral edge; front panels hingedly connected to the second side panel along a third fold line; a cover panel hingedly connected to the front panels along a fourth fold line; and shelves hingedly connected to respective first side panels along fifth fold lines extending transversely to the first fold line.

To assemble the display, the panels are folded along the first, second, third, and fourth fold lines so that the back panel, the side panels, and the front panels surround an interior space, and the cover panel overlaps the first side panels. Latches are provided to retain the cover panel on the first side panels. Each shelf is folded along a respective fifth fold line to extend into the interior space, where it is supported by ledges on the second side panel and held in place by tabs which snap into slots.

Since the shelves are formed integrally with the first side panels, they can extend forward of the front panels and thus be supported by the front panels. This also provides for improved product storage capacity and visibility. The angle of the fifth fold lines with respect to the first fold lines determines the incline of the shelves in the assembled state.

The display can be collapsed by folding the shelves along the fifth fold lines to be substantially coplanar with the first side panels, and folding the panels so that the back panel and the second side panel are substantially coplanar, and so that front panels and the cover panel are substantially coplanar. The fully collapsed display is essentially three times the thickness of the unfolded sheet and may be stacked.

The display according to the invention is preferably made of injection molded plastic such as PVC, polyethylene, or polystyrene. This permits molding latches, tabs, recesses, apertures and other retaining features which preclude the necessity of using glue or fasteners. The fold lines follow parallel molded grooves which form "living hinges".

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
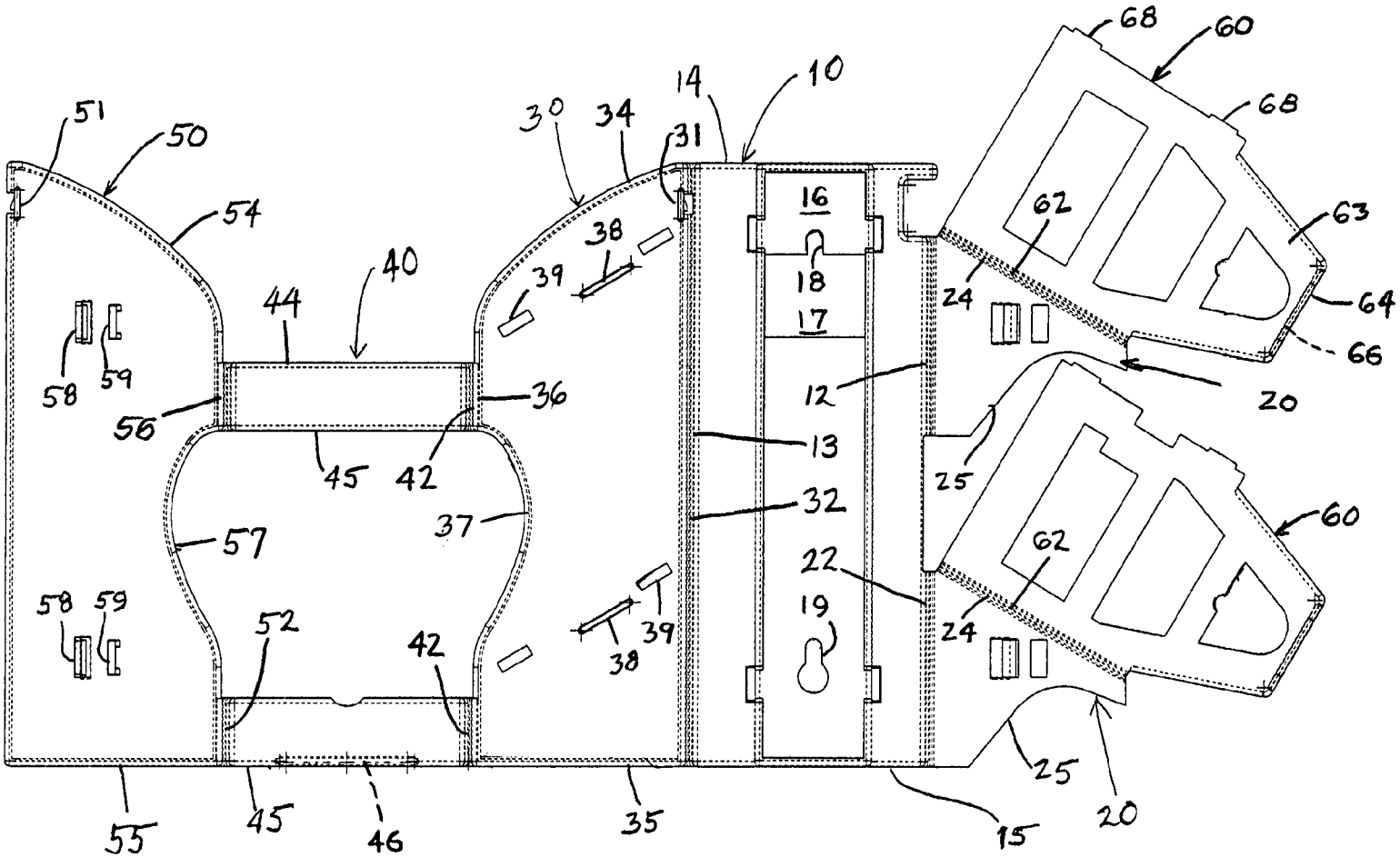
FIG. 1 is a plan view of the inside surface of the unfolded blank for the merchandising display according to an embodiment of the present invention.

Referring to FIG. 1, the unfolded blank includes a back panel 10, a pair of first side panels 20, a second side panel 30, a pair of front panels 40, a cover panel 50, and a pair of shelves 60 connected to respective first side panels 20. The blank is preferably injection molded of polystyrene, with grooves forming living hinges along fold lines between the panels.

The back panel 10 has parallel first and second lateral edges 12, 13, an upper edge 14, and a lower edge 15. The first side panels 20 are connected to first lateral edge 12 along a first fold line 22, the second side panel 30 being connected to the second lateral edge along a second fold line 32. Each first side panel 20 has a straight upper edge 24 at about sixty degree to the first fold line 22, and a concavely curved lower edge 25. Shelves 60 are connected to respective upper edges 24 along fifth fold lines 62, and are coplanar with first side panels 20 prior to folding.

The second side panel 30 has a curved upper edge 34, a flat lower edge 35, and a forward edge 36 with a central cutout 37. The front panels 40 are connected to the forward edge 36 of the second side panel 30 along a third fold line 42 on either side of the cutout 37. The cover panel 50 has a curved upper edge 54, a flat lower edge 55, and a forward edge 56 with a central cutout 57, the cover panel 50 having a profile which is essentially the mirror image of the profile of the second side panel 30. The front panels 40 are connected to the forward edge 56 of the cover panel 50 along a fourth fold line 52 on either side of the cutout 57.

Features of the individual panels and shelves will now be discussed in greater detail.

The back panel 10 has a central channel 16 with a rectangular aperture 17 having a notch 18 for receiving a hook or screw, as well as a pear-shaped aperture 19 for receiving a second screw, if the display is mounted on a wall. A pair of spaced apart retaining tabs 31, 51, located on respective panels 30, 50 on either side of the channel 16 near the top edge 14, are designed to hold a card identifying the product or other advertising against the back panel 10. The first side panels 20 each have a retaining aperture 28 which receives a respective latch 58 on the cover panel 50, as will be described.

Figure 2:
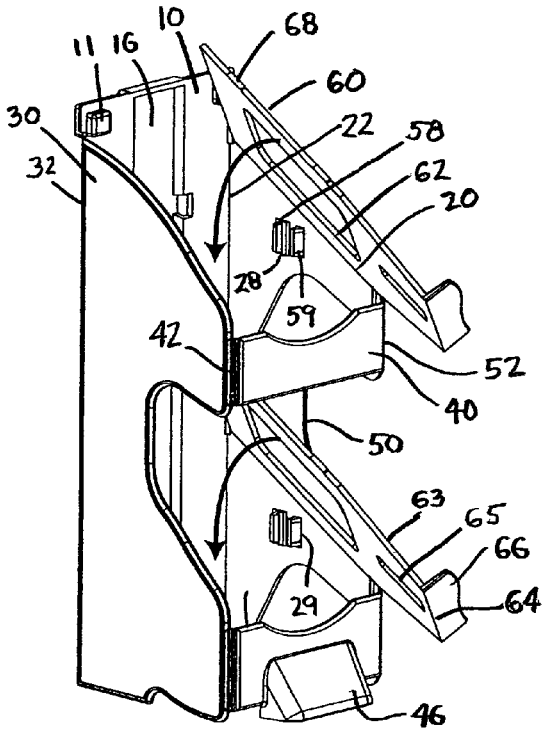
FIG. 2 is a perspective of the preassembled display as the shelves are being folded into position.
Figure 3:
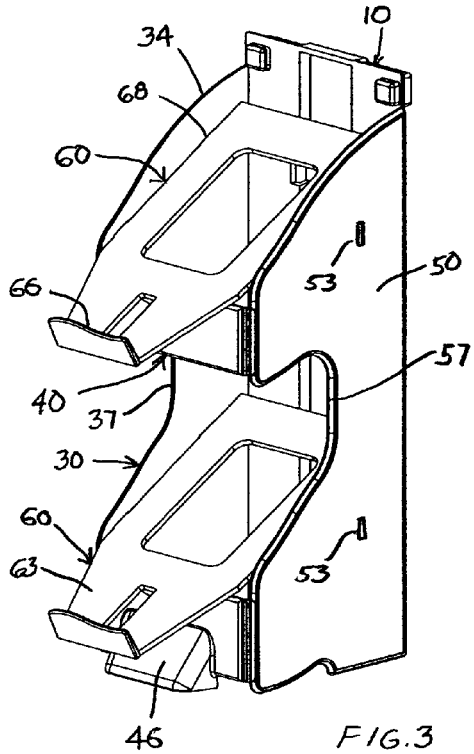
FIG. 3 is a perspective of the display in the fully assembled state.

The shelves 60 each have a pair of tabs 68 opposite the fifth fold lines 62, a tongue 63 extending to a forward edge 64, an aperture 65 in the tongue 63, and a stop 66 upstanding from the edge 64. The second side panel 30 is provided with a pair of parallel upstanding ledges 38, and a pair of linear recesses 39 aligned with each ledge 38 on either side thereof. The ledges 38 are designed to support respective shelves 60 while the recesses 39 receive the tabs 68 to lock the shelves 60 in position in the fully assembled state (FIG. 3). The front panels 40 each have an upper edge 44 which provides additional support for a respective shelf 60, a lower edge 45. The lower front panel 40 also has a foot 46 (FIG. 2) that provides stability when the assembled display is freestanding.

The cover panel 50 has two upstanding latches 58 which engage the latching apertures 28 in the first side panels 20 to fix the panels 20, 50 together in the collapsed or preassembled state (FIGS. 4 and 5) as well as the fully assembled state. Each latch 58 is flanked by a hole 53 which receives a core pin for molding a catch on the end of the latch, and is paired with a post 59 received in an aperture 29 in the corresponding first panel 20 to urge the catch into engagement with the respective aperture 28.

Note that the back panel 10 and the front panels 40 have the same width, and the second side panel 30 and the cover panel 50 have the same width, so that the assembled display will have a rectangular cross section when assembled. However it is also possible for the front panels 40 to be narrower than the back panel 10, so that the cross-section will be trapezoidal. The lower edges 15, 35, 45, and 55 are essentially collinear, so the assembled display will have a rectangular or trapezoidal footprint.

The assembly steps will now be described briefly. Referring to FIG. 2, the first side panels 20 have been folded along the first fold line 22 to extend forward from the back panel 10, the second side panel 30 has been folded along the second fold line 32 to extend forward from the back panel 10, the front panels 40 have been folded along the third fold line 42 to extend between the side panels 20, 30, and the cover panel 50 has been folded along the fourth fold line 52 to lie against the first side panels 20. The latches 58 engage apertures 28 and the posts 59 engage the apertures 29 to maintain the panels 20, 50 in a latched state. The shelves 60 can then be swung into position on respective front panels 40, the tabs 68 being received in recesses 39 (FIG. 1). Until this is done the assembly can still be flexed along the fold lines 22, 32, 42, 52 so that the assembly has a parallelogram cross-section or lies flat, as will be described.

With the shelves 60 in the latched or assembled position shown in FIG. 3, the upstanding stops 66 limit downward travel of product supported on inclined surfaces resulting from the angle of the fifth fold lines 52 with respect to the first fold line 22. The cutouts 37, 57 in the panels 30, 50 facilitate access to the lower shelf. Note that FIGS. 2-5 depict an embodiment with minor differences from the unfolded blank of FIG. 1. In particular, the upper edge 14 of the back panel 10 is above the upper edges 32, 52 of adjacent panels 30, 50, and tabs 11 for retaining product indicia are provided on the back panel 10, as compared to tabs 31, 51 (FIG. 1) which pivot into place parallel to the back panel.

Figure 5:
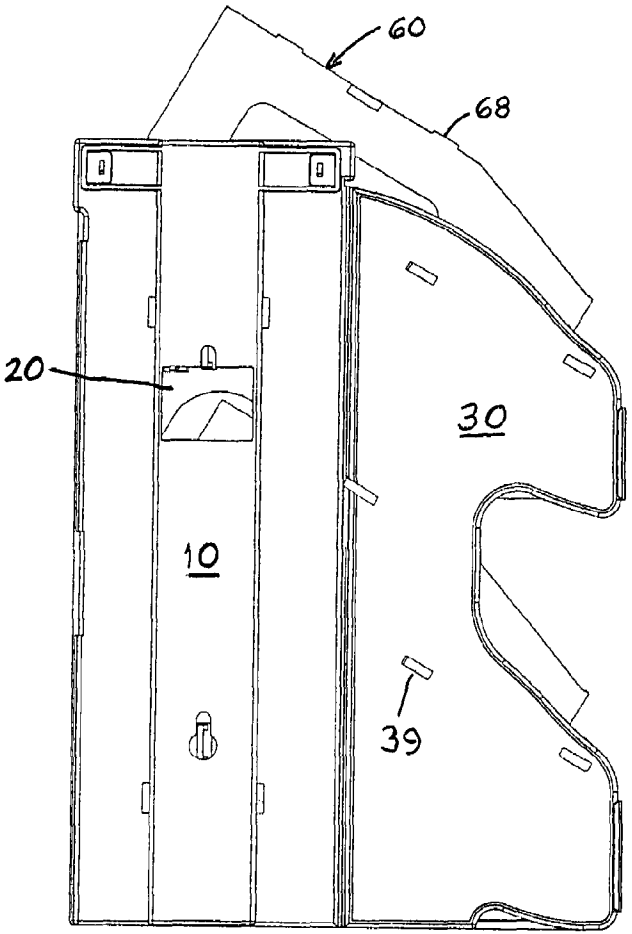
FIG. 5 is a rear plan view of the display when fully collapsed.
Figure 4:
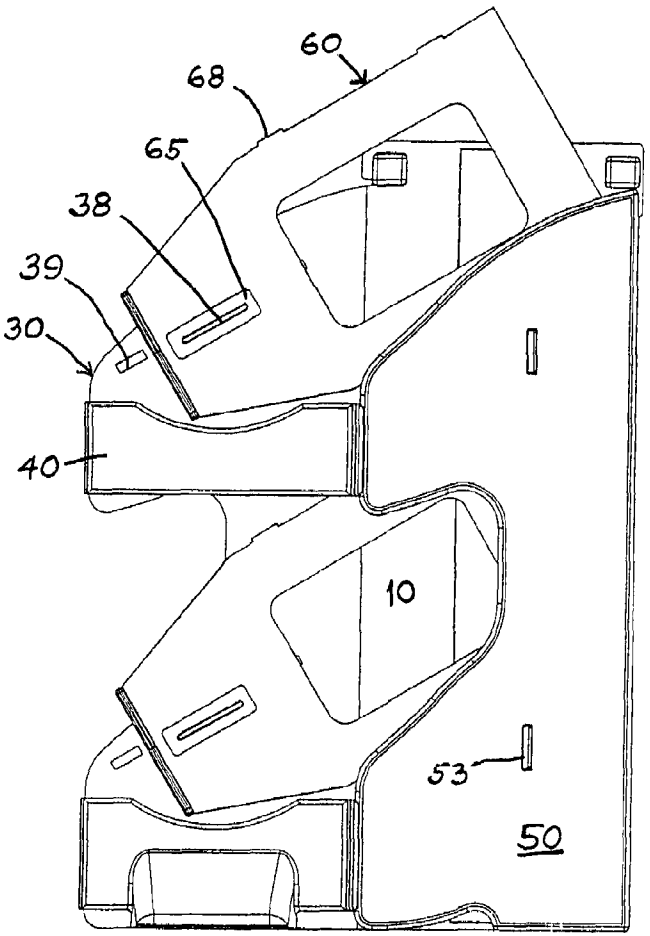
FIG. 4 is a front plan view of the display when fully collapsed.

FIGS. 4 and 5 are front and rear views of the collapsed display, wherein the shelves 60 are unlatched from the second side panel 30 and the display is collapsed so that the front panels 40 and the cover panel 50 lie over the back panel 10 and the second side panels 30, with the first side panels 20 and the part of the shelves 60 sandwiched between the cover panel 50 and the back panel 10. Alternatively, if it is desired to ship the display in a collapsed or preassembled state, the shelves 60 are not swung into position as shown in FIGS. 2 and 3, but remain coplanar with the first side panels 20 after latching the cover panel 50 to the side panels 20. The ledges 38 on the second side panel 30 are received through apertures 65 in the shelves 60 and do not extend substantially above the cover, so that the collapsed displays can be stacked in a minimum of space.

From the collapsed state, a point of purchase vendor would only have to pull the front panels 20 away from the back panel 10, drop the shelves 60 into a latched position (FIG. 3), and load the display with product for display to customers. He might also wish to place a product identifier under the tabs 11 (or 31, 51) at the top of back panel 10. The display is configured to be freestanding, but can also be fixed to a wall using the notch 18 and pear-shaped hole 19 in the channel 16 of the back panel.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A collapsible merchandising display comprising:

a back panel having first and second lateral edges;

at least one first side panel hingedly connected to said back panel at a first fold line along said first lateral edge;

at least one second side panel hingedly connected to said back panel at a second fold line along said second lateral edge;

at least one front panel hingedly connected to said at least one second side panel along a third fold line;

at least one cover panel hingedly connected to said at least one front panel along a fourth fold line; and at least one shelf hingedly connected to said at least one first side panel at a respective said at least one fifth fold line extending transversely to said first fold line;

wherein said panels are folded along said first, second, third, and fourth fold lines so that said back panel, said side panels, and said at least one front panel surround an interior space and said at least one cover panel lies against said at least one first side panel and each said shelf is folded along a respective said fifth fold line to extend into said interior space;

whereby said display can be collapsed by folding said shelves along said fifth fold lines to be substantially coplanar with said at least one first side panel, and folding said panels so that said back panel and said at least one second side panel are substantially coplanar, and so that said at least one front panel and said at least one cover panel are substantially coplanar.

2. The collapsible merchandising display of claim 1 wherein said display is made of a single piece of plastic material, said fold lines being formed by grooves in said plastic.

3. The collapsible merchandising display of claim 2 wherein said display is injection molded.

4. The collapsible merchandising display of claim 1 wherein said first, second, third, and fourth fold lines are at least substantially parallel.

5. The collapsible merchandising display of claim 1 wherein said interior space has a substantially rectangular cross section.

6. The collapsible merchandising display of claim 1 wherein each said shelf comprises a tongue which is supported on a respective said front panel.

7. The collapsible merchandising display of claim 6 wherein said tongue has a forward edge with an upstanding stop for retaining merchandise on said shelf.

8. The collapsible merchandising display of claim 1 wherein said at least one second side panel is provided with at least one upstanding ledge which supports a respective at least one shelf.

9. The collapsible merchandising display of claim 8 each said shelf has an aperture which receives a respective said ledge when said display is collapsed.

10. The collapsible merchandising display of claim 1 each said shelf has a lateral edge provided with at least one tab, said at least one second side panel having at least one aperture which receives a respective at least one tab to positively position said shelf in said interior space.

11. The collapsible merchandising display of claim 1 wherein said at least one first side panel and said cover have latching features which engage to mechanically retain said at least one cover panel against said at least one first side panel.

12. T he collapsible merchandising display of claim 11 wherein said at least one cover is provided with upstanding latches and said at least one first side panel is provided with apertures which receive respective said latches in latching engagement.

13. The collapsible merchandising display of claim 1 wherein said back panel has an inside surface provided with upstanding retaining features for holding product indicia.

14. The collapsible merchandising display of claim 13 wherein the back panel has an inside surface having a central channel provided with mounting holes for suspending the display on a vertical surface.

15. The collapsible merchandising display of claim 1 wherein said at least one front panel includes a bottom front panel having a forward extending foot for added stability when the display sits on a horizontal surface.

* * * * *